US008119056B2

(12) United States Patent
Kawai et al.

(10) Patent No.: US 8,119,056 B2
(45) Date of Patent: Feb. 21, 2012

(54) END FACE PROCESSING APPARATUS, END FACE PROCESSING SYSTEM, END FACE PROCESSING METHOD FOR HONEYCOMB MOLDED BODY, AND MANUFACTURING METHOD FOR HONEYCOMB STRUCTURE

(75) Inventors: Tsuyoshi Kawai, Gifu (JP); Eiji Sumiya, Gifu (JP); Yoshiteru Ohira, Gifu (JP)

(73) Assignee: Ibiden Co., Ltd., Gifu (JP)

( * ) Notice: Subject to any disclaimer, the term of this patent is extended or adjusted under 35 U.S.C. 154(b) by 930 days.

(21) Appl. No.: 11/546,417

(22) Filed: Oct. 12, 2006

(65) Prior Publication Data

US 2008/0006971 A1 Jan. 10, 2008

(30) Foreign Application Priority Data

Jul. 7, 2006 (EP) ..... 06116847

(51) Int. Cl.
*B28B 3/20* (2006.01)

(52) U.S. Cl. ..... 264/630; 264/631; 451/51; 451/61; 451/70

(58) Field of Classification Search ..... 264/630, 264/631; 451/51, 61, 70
See application file for complete search history.

(56) References Cited

U.S. PATENT DOCUMENTS 5,914,187 A 6/1999 Naruse et al.
6,596,372 B2 * 7/2003 Ito et al. ..... 428/116
6,669,751 B1 12/2003 Ohno et al.
6,764,743 B2 * 7/2004 Kato et al. ..... 428/118
6,863,705 B2 * 3/2005 Ishihara et al. ..... 55/523
7,112,233 B2 9/2006 Ohno et al.
7,309,370 B2 12/2007 Kudo et al.
7,332,014 B2 2/2008 Ono et al.
7,341,614 B2 3/2008 Hayashi et al.
7,348,049 B2 3/2008 Yoshida
7,387,829 B2 6/2008 Ohno et al.
7,393,376 B2 7/2008 Taoka et al.
7,396,586 B2 7/2008 Ohno et al.
7,427,308 B2 9/2008 Taoka et al.
7,427,309 B2 9/2008 Ohno et al.
7,438,967 B2 10/2008 Fujita (Continued)

FOREIGN PATENT DOCUMENTS

EP 1 595 666 11/2005

(Continued)

OTHER PUBLICATIONS

Tsuyoshi Kawai, et al., "Cutting apparatus, honeycomb molded body cutting method, and honeycomb structure manufacturing method", U.S. Appl. No. 11/513,115, filed Aug. 31, 2006.

(Continued)

*Primary Examiner* — Matthew Daniels
*Assistant Examiner* — Russell Kemmerle, III
(74) *Attorney, Agent, or Firm* — Finnegan, Henderson, Farabow, Garrett & Dunner, LLP

(57) ABSTRACT

The end face processing apparatus of the present invention is an end face processing apparatus for processing the cut face of a cut ceramic molded body, which comprises an air blowing outlet and an extraneous material removal member, and is configured to remove burrs remaining on the cut face from the time of cutting as well as powder adhering to the cut face and on the periphery thereof using the extraneous material removal member and air from the air blowing outlet.

16 Claims, 6 Drawing Sheets

U.S. PATENT DOCUMENTS

| | | | | |
|---|---|---|---|---|
| 7,449,427 | B2 | 11/2008 | Ohno et al. | |
| 7,462,216 | B2 | 12/2008 | Kunieda et al. | |
| 7,473,465 | B2 | 1/2009 | Ohno et al. | |
| 2004/0161596 | A1 | 8/2004 | Taoka et al. | |
| 2005/0109023 | A1 | 5/2005 | Kudo et al. | |
| 2005/0153099 | A1 | 7/2005 | Yamada | |
| 2005/0169819 | A1 | 8/2005 | Shibata | |
| 2005/0175514 | A1 | 8/2005 | Ohno | |
| 2005/0180898 | A1 | 8/2005 | Yamada | |
| 2005/0247038 | A1 | 11/2005 | Takahashi | |
| 2005/0272602 | A1 | 12/2005 | Ninomiya | |
| 2006/0029897 | A1 | 2/2006 | Saijo et al. | |
| 2006/0029898 | A1 | 2/2006 | Saijo et al. | |
| 2006/0043562 | A1 | 3/2006 | Watanabe | |
| 2006/0051556 | A1 | 3/2006 | Ohno et al. | |
| 2006/0073970 | A1 | 4/2006 | Yamada | |
| 2006/0108347 | A1 | 5/2006 | Koyama et al. | |
| 2006/0118546 | A1 | 6/2006 | Saijo | |
| 2006/0166820 | A1 | 7/2006 | Ogyu et al. | |
| 2006/0169384 | A1* | 8/2006 | Fujita et al. | 156/1 |
| 2006/0210765 | A1 | 9/2006 | Ohno et al. | |
| 2006/0216466 | A1 | 9/2006 | Yoshida | |
| 2006/0216467 | A1 | 9/2006 | Yoshida | |
| 2006/0222812 | A1 | 10/2006 | Koyama et al. | |
| 2006/0225390 | A1 | 10/2006 | Yoshida | |
| 2006/0230732 | A1 | 10/2006 | Kunieda | |
| 2006/0245465 | A1 | 11/2006 | Saijo et al. | |
| 2007/0020155 | A1 | 1/2007 | Ohno et al. | |
| 2007/0028575 | A1 | 2/2007 | Ohno et al. | |
| 2007/0044444 | A1 | 3/2007 | Oshimi | |
| 2007/0068128 | A1 | 3/2007 | Oshimi et al. | |
| 2007/0116908 | A1 | 5/2007 | Ohno et al. | |
| 2007/0126160 | A1 | 6/2007 | Takahashi | |
| 2007/0128405 | A1 | 6/2007 | Sakaguchi et al. | |
| 2007/0130897 | A1 | 6/2007 | Sakaguchi et al. | |
| 2007/0144561 | A1 | 6/2007 | Saijo et al. | |
| 2007/0148403 | A1 | 6/2007 | Yamamura et al. | |
| 2007/0152382 | A1 | 7/2007 | Yamada et al. | |
| 2007/0158879 | A1* | 7/2007 | Suwabe et al. | 264/630 |
| 2007/0169453 | A1 | 7/2007 | Hayakawa | |
| 2007/0175060 | A1 | 8/2007 | Idei et al. | |
| 2007/0178275 | A1 | 8/2007 | Takahashi | |
| 2007/0187651 | A1 | 8/2007 | Naruse et al. | |
| 2007/0190350 | A1 | 8/2007 | Ohno et al. | |
| 2007/0196620 | A1 | 8/2007 | Ohno et al. | |
| 2007/0199205 | A1 | 8/2007 | Hoshino et al. | |
| 2007/0204580 | A1 | 9/2007 | Kunieda | |
| 2007/0212517 | A1 | 9/2007 | Ohno et al. | |
| 2007/0235895 | A1 | 10/2007 | Yamamura et al. | |
| 2007/0262498 | A1 | 11/2007 | Saijo et al. | |
| 2007/0293392 | A1 | 12/2007 | Ohno et al. | |
| 2008/0067725 | A1 | 3/2008 | Naruse et al. | |
| 2008/0084010 | A1 | 4/2008 | Naruse et al. | |
| 2008/0088072 | A1 | 4/2008 | Kobayashi | |
| 2008/0106008 | A1 | 5/2008 | Kasai et al. | |
| 2008/0106009 | A1 | 5/2008 | Naruse et al. | |
| 2008/0116200 | A1 | 5/2008 | Kawai et al. | |
| 2008/0120950 | A1 | 5/2008 | Ohno et al. | |
| 2008/0136053 | A1 | 6/2008 | Kuribayashi et al. | |
| 2008/0136062 | A1 | 6/2008 | Kasai et al. | |
| 2008/0138567 | A1 | 6/2008 | Ninomiya et al. | |
| 2008/0157445 | A1 | 7/2008 | Kawai et al. | |
| 2008/0174039 | A1 | 7/2008 | Saijo et al. | |
| 2008/0190081 | A1 | 8/2008 | Oshimi | |
| 2008/0190083 | A1 | 8/2008 | Oshimi | |
| 2008/0213485 | A1 | 9/2008 | Shibata | |
| 2008/0233345 | A1* | 9/2008 | Allen | 428/116 |
| 2008/0236115 | A1 | 10/2008 | Sakashita | |
| 2008/0236122 | A1 | 10/2008 | Ito | |
| 2008/0236724 | A1 | 10/2008 | Higuchi | |
| 2008/0241015 | A1 | 10/2008 | Kudo et al. | |
| 2008/0241444 | A1 | 10/2008 | Oshimi | |
| 2008/0241466 | A1 | 10/2008 | Saito et al. | |
| 2008/0284067 | A1 | 11/2008 | Naruse et al. | |
| 2008/0305259 | A1 | 12/2008 | Saijo | |
| 2008/0318001 | A1 | 12/2008 | Sakakibara | |
| 2009/0004431 | A1 | 1/2009 | Ninomiya | |

FOREIGN PATENT DOCUMENTS

| | | | |
|---|---|---|---|
| JP | 5-285929 | | 11/1993 |
| JP | 8-117713 | | 5/1996 |
| JP | 10-99626 | | 4/1998 |
| JP | 2000-043024 | | 2/2000 |
| WO | WO 2004/065088 | * | 5/2004 |

OTHER PUBLICATIONS

Takehisa Yamada, "Die for Extrusion-Molding and Method for Manufacturing Porous Ceramic Member", U.S. Appl. No. 11/541,724, filed Oct. 3, 2006.
Extended Search Report on EP 06116847.2.
U.S. Appl. No. 11/845,975.
U.S. Appl. No. 11/867,256.
U.S. Appl. No. 11/963,381.
U.S. Appl. No. 11/695,246.
U.S. Appl. No. 11/696,976.
U.S. Appl. No. 11/749,961.
U.S. Appl. No. 11/748,099.
U.S. Appl. No. 11/746,895.
U.S. Appl. No. 11/513,115.
U.S. Appl. No. 11/762,928.
U.S. Appl. No. 11/765,088.
U.S. Appl. No. 11/174,483, Unpublished.
U.S. Appl. No. 11/225,197, Unpublished.
U.S. Appl. No. 11/711,021.
U.S. Appl. No. 11/951,949.

* cited by examiner

B-B Line cross-section view

A-A Line cross-section view

END FACE PROCESSING APPARATUS, END FACE PROCESSING SYSTEM, END FACE PROCESSING METHOD FOR HONEYCOMB MOLDED BODY, AND MANUFACTURING METHOD FOR HONEYCOMB STRUCTURE

CROSS-REFERENCE TO RELATED APPLICATIONS

This application claims benefit of priority based on European patent application EP 06116847.2 filed on Jul. 7, 2006. The contents of this application are incorporated herein by reference in their entirety.

BACKGROUND OF THE INVENTION

1. Field of the Invention

The present invention relates to an end face processing apparatus, an end face processing system, an end face processing method for a honeycomb molded body, and a manufacturing method for a honeycomb structure.

2. Discussion of the Background

The harm caused to the environment and the human body by particulates such as soot contained in exhaust gas discharged from internal combustion engines such as in buses, trucks and other vehicles, construction machines, and the like has recently become a problem.

A variety of honeycomb filters using a honeycomb structure made from porous ceramics have been proposed as filters to capture particulates in exhaust gas, thereby purifying it.

FIG. 1 is a perspective view schematically showing an example of such a honeycomb structure; FIG. 2A is a perspective view schematically showing a honeycomb fired body constituting the honeycomb structure, and FIG. 2B is a cross-section view of the line B-B in FIG. 2A.

In a honeycomb structure 130, a plurality of honeycomb fired bodies 140 such as shown in FIG. 1 are bound together through a sealing material layer (adhesive layer) 131 to form a ceramic body 133, and a sealing material layer (coat layer) 132 is formed at the outer periphery of the ceramic block 133. As shown in FIGS. 2A and 2B, many cells 141 are provided along the long side of the honeycomb fired body 140 and a cell wall 143 dividing the cells 141 functions as a filter.

In further detail, as shown in FIG. 2B the end portion of either the exhaust gas inlet or outlet side of the cells 141 formed at the honeycomb fired body 140 is sealed by a plug material layer 142; exhaust gas flowing into one of the cells 141 always passes through the cell wall 143 dividing the cells 141 and flows out from another one of the cells 141; when the exhaust gas passes through the cell wall 143, particulates are captured by the cell wall 143, to purify the exhaust gas.

Conventionally, when such a honeycomb structure 130 is manufactured, a ceramic powder comprising a raw ingredient powder, is mixed with a binder, a liquid dispersing medium and the like are added, and the result is mixed to prepare a wetting mixture. The wetting mixture is continuously extrusion molded using a die, and the extruded molded body is cut at prescribed length to produce rectangular pillar-shaped honeycomb molded bodies.

Next, the obtained honeycomb molded bodies are dried using a microwave drier or hot air drier, the dried honeycomb molded bodies are cut again into precise lengths, and prescribed cells are sealed thereafter, to fabricate sealed honeycomb molded bodies having one of the end portions of the cells sealed with a plug material layer. The honeycomb molded bodies are then degreased, after which, the results are loaded on a firing jig and fired to form honeycomb fired bodies.

Then, after a gap retention material is set up on the side surface of the honeycomb fired bodies, a sealing material paste is applied, the honeycomb fired bodies are attached at an interval mediated by the gap retention material, and fabricated is an aggregate of honeycomb fired bodies with many honeycomb fired bodies bound together through the sealing material layer (adhesive layer).

Next, cutting apparatuses and the like are used to cut the obtained honeycomb fired body aggregate into cylindrical pillars, elliptical pillars, or other prescribed shapes to form ceramic blocks, and finally, a sealing material paste is applied to the outer periphery of the ceramic blocks to form a sealing material layer (coat layer), concluding the manufacture of the honeycomb structure.

If a cutter or the like is used to cut after drying in the manufacturing process described above, a type of nap, so-called burrs, extending to the periphery from the cut portion is formed on the cut portion. Powder originating during the time of cutting at or nearby the cut portion will adhere thereto and so must be removed.

Brushing the cut portion while blowing air from through holes (cells) in a honeycomb molded body is described in JP-A 2000-43024 as a method to remove burrs and the like occurring after cutting such honeycomb molded body.

The contents of JP-A 2000-43024 are incorporated herein by reference in their entirety.

SUMMARY OF THE INVENTION

The end face processing apparatus of the present invention is an end face processing apparatus for processing the cut surface of a ceramic molded body subjected to cutting, wherein:

an air blowing outlet and an extraneous matter removal member are provided, and the configuration is such as to remove burrs left on a cut face at the time when the ceramic body has been subjected to cutting and powder adhering to the cut face and the periphery thereof with the above-mentioned extraneous matter removal member and air from the air blowing outlet described above.

In the above-mentioned end face processing apparatus, the extraneous matter removal member preferably comprises one member chosen among the group consisting of: a brush, a cloth, a sponge, a buff, a grindstone, and a sheet-shaped object. Further, the extraneous matter removal member is preferably a roller with a brush, and the air blowing outlet and the extraneous matter removal member are preferably disposed at the same cut face side of the ceramic molded body.

In the end face processing apparatus of the present invention, the air blowing outlet is desirably provided with a cylindrical object and an air blowing means to blow air out from the cylindrical object, and the rate of air blowing out from the air blowing outlet is desirably at least about 1 m/sec and at most about 10 m/sec. Moreover, the extraneous material removal member is desirably provided with a dust collection device.

An end face processing system of the present invention comprises at least one of the above-mentioned end face processing apparatus for processing one cut face of a cut-processed ceramic molded body, and at least one of the above-mentioned end face processing apparatus for processing the opposite cut face of the ceramic molded body, and the processing of one cut face and the processing of the opposite cut face are performed simultaneously.

In the above-mentioned end face processing system, desirably, the extraneous material removal member comprises one member chosen among the group consisting of a brush, a cloth, a sponge, a buff, a grindstone, and a sheet-shaped object. Furthermore, the extraneous material removal member is desirably a roller with a brush, and the air blowing outlet and the extraneous material removal member are desirably provided at the same cut face side of the ceramic molded body.

In the end face processing system of the present invention, the air blowing outlet is desirably provided with a cylindrical object and an air blowing means to blow air out from the cylindrical object, and the rate of air blowing out from the air blowing outlet is desirably at least about 1 m/sec and at most about 10 m/sec. Moreover, the extraneous material removal member is desirably provided with a dust collection device.

The end face processing method for honeycomb molded bodies of the present invention is an end face processing method for honeycomb molded bodies in which many cells are arranged along a long side divided by a cell wall and a cut face of a pillar-shaped honeycomb molded body whose end portion has been cut using an end face processing apparatus, wherein:

the end face processing apparatus is provided with an air blowing outlet and an extraneous matter removal member, and the extraneous matter removal member is driven with at least one mode chosen between vibration, rotation, and translation while brought into contact with the cut face, and air is blown out of the air blowing outlet to remove burrs remaining on the cut face and powder adhering to the cut face and the periphery thereof.

In the end face processing method for honeycomb molded bodies described above, desirably the extraneous material removal member comprises one member chosen among the group consisting of a brush, a cloth, a sponge, a buff, a grindstone, and a sheet-shaped object. Moreover, it is desirable for a roller with a brush to be used as the extraneous matter removal member and to rotate the roller with a brush while causing contact; it is desirable for the air blowing outlet and the extraneous matter removal member to be disposed on the same cut face side of the honeycomb molded body; and it is desirable for processing of the cut face of the honeycomb molded body to be carried out simultaneously on both end faces of the honeycomb molded body.

In an advantageous embodiment of the end face processing method for honeycomb molded bodies according to the present invention, air is desirably blown inside the cells of the honeycomb molded body.

In the end face processing method for honeycomb molded bodies of the present invention, the air blowing outlet is desirably provided with a cylindrical object and an air blowing means to blow air out from the cylindrical object, and the rate of air blowing out from the air blowing outlet is desirably at least about 1 m/sec and at most about 10 m/sec. Moreover, the extraneous material removal member is desirably provided with a dust collection device.

The manufacturing method for honeycomb structures of the present invention is a method for manufacturing honeycomb structures made from honeycomb fired bodies by molding ceramic raw materials to fabricate pillar-shaped honeycomb molded bodies in which many cells are arranged along a long side divided by a cell wall, cutting both sides of the honeycomb molded bodies, processing the cut face using an end face processing apparatus, and then firing the honeycomb molded bodies, wherein:

the end face processing apparatus is provided with an air blowing outlet and an extraneous matter removal member, and the extraneous matter removal member is driven with at least one mode chosen between vibration, rotation, and translation while brought into contact with the cut face, and air is blown out of the air blowing outlet to remove burrs remaining on the cut face and powder adhering to the cut face and the periphery thereof.

In the manufacturing method for honeycomb structures, desirably, the extraneous material removal member comprises one member chosen among the group consisting of a brush, a cloth, a sponge, a buff, a grindstone, and a sheet-shaped object; it is desirable for a roller with a brush to be used as the extraneous matter removal member and to rotate the roller with a brush while causing contact; it is desirable for the air blowing outlet and the extraneous matter removal member to be disposed on the same cut face side of the honeycomb molded body; and it is desirable for processing of the cut face of the honeycomb molded body to be carried out simultaneously on both end faces of the honeycomb molded body.

In the manufacturing method for honeycomb molded bodies of the present invention, the air blowing outlet is desirably provided with a cylindrical object and an air blowing means to blow air out from the cylindrical object, and the rate of air blowing out from the air blowing outlet is desirably at least about 1 m/sec and at most about 10 m/sec. Moreover, the extraneous material removal member is desirably provided with a dust collection device.

DESCRIPTION OF THE EMBODIMENTS

Figure 1:
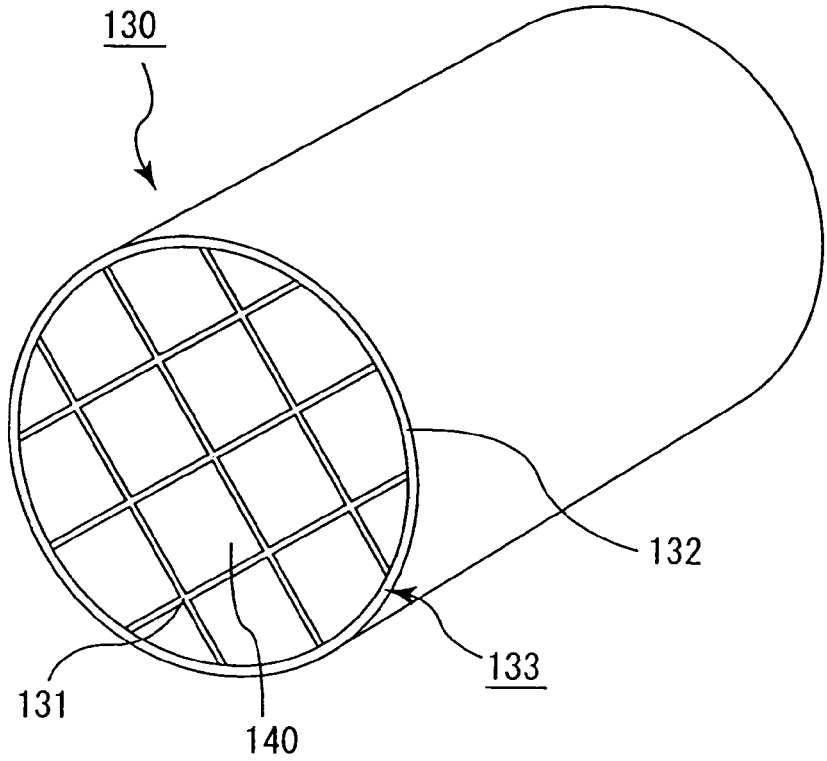
FIG. 1 is a perspective view schematically showing an example of the honeycomb structures.

The end face processing apparatus according to the embodiments of the present invention is an end face processing apparatus for processing a cut face of a ceramic molded body subjected to cutting, wherein:

an air blowing outlet and an extraneous matter removal member are provided, and the configuration is such as to remove burrs left on a cut face at the time when the ceramic molded body has been subjected to cutting and powder adhering to the cut face and the periphery thereof with an extraneous matter removal member and air from the air blowing outlet described above.

The end face processing apparatus according to the above mentioned embodiments is an apparatus for processing the cut face of a cut ceramic molded body, and is provided with an air blowing outlet and an extraneous matter removal member.

The ceramic molded body that is the object of cutting in the present invention has a ceramic powder and an organic binder as its main components.

The ingredients for the ceramic powder described above are not particularly restricted, but may include a ceramic nitride such as aluminum nitride, silicon nitride, boron nitride, or titanium nitride, a ceramic carbide such as silicon carbide zirconium carbide, titanium carbide, tantalum carbide or tungsten carbide, or a ceramic oxide such as aluminum oxide, zirconia, cordierite, mullite, or aluminum titanate, for example.

Further, the ingredients may be a silicon-containing ceramic in which a metal silicon is blended in the ceramic described above, or a ceramic bonded with silicon or a silicate compound and, for example, a blend of metal silicon with silicon carbide may be preferable for use. In that case, silicon carbide powder and metal silicon powder are used to fabricate the ceramic molded body.

The organic binder is not particularly restricted; for example, methyl cellulose, carboxymethylcellulose, hydroxyethylcellulose, polyethylene glycol, and the like may also be used. Among these, methyl cellulose is the most desirable. The ceramic molded body may also contain a plasticizer or a lubricant.

When producing a ceramic molded body, a liquid dispersing medium made from water, an organic solvent such as benzene, an alcohol such as methanol, and the like, for example, is ordinarily used, and such a liquid dispersing medium may be left in the ceramic molded body.

The form of the ceramic molded body is not particularly restricted; a pillar-shaped honeycomb molded body with many cells arranged along a long side divided by a cell wall is fine, a molded body whose inside is completely filled with the material constituting the ceramic molded body is fine, and a body formed with a hollow or through holes of various shapes is also fine.

The ceramic molded body which is the object of the end face processing apparatus according to the embodiments of the present invention is a cut ceramic molded body, but the cutting method is not restricted; cutting tools such as a disk-shaped cutter may be used, for example, and cutting may be carried out with other cutting devices as well. Cases where the end face is subjected to cut off grinding with a grinding tool, and is thereby flattened are also considered to have been "cut".

"Burrs" refers to residues, naps, and the like extending from the end portion of a cut face and result from the cutting; they need to be removed along with powder adhering to the ceramic molded body, which scatter due to the cutting. In the present invention, one embodiment of an end face processing apparatus provided with an air blowing outlet and an extraneous matter removal member removes these items.

The air blowing outlet refers to a blowing outlet of the cylindrical object made from resin, metal, ceramic, or the like for blowing air out onto the cut face of a ceramic molded body. Accordingly, to be specific, the end face processing apparatus of the present invention is provided with the above-mentioned cylindrical object as well as an air blowing means such as a compression pump, a fan, a gas cylinder or the like to blow air out from the cylindrical object.

A desirable rate for blowing air from the air blowing outlet is at least about 1 m/sec. and at most about 10 m/sec.

The end face processing apparatus according to the embodiments of the present invention is further provided with an extraneous matter removal member.

The extraneous matter removal member is not particularly restricted, but refers to a member that can remove burrs and the like by being driven with at least one mode out of vibration, rotation, and translation while brought into contact with the cut face, for example. A brush, cloth, sponge, buff, grindstone, sheet-shaped object, and the like are suggested as examples of the extraneous matter removal member.

The brush types described above are not restricted; a variety of brushes may be used, examples of which include a channel linear brush, a channel roll-type brush, a wheel-type brush, a cup-type brush, a coil-type brush, a twisting brush, a beveled brush, and a writing brush. These may be an ordinarily configured brush or one with a shaft.

The material of the brushes is not particularly restricted; one using polymer molecules such as nylon fibers, aramid fiber, acryl fiber or the like may be used, or one with metal filaments such as stainless steel filaments, brass filaments, wrapping filaments, or the like may be used; however, the ceramic molded body that is the object of the burr or other such removal is relatively soft, so it is desirable that the brush is also soft, made of resin or the like so that the ceramic molded body does not readily develop scratches.

It is desirable for the extraneous matter removal member to be a roller with a brush that is rotated by a motor or the like to remove the extraneous matter. If the roller with a brush is used, a rotational speed of at least about 50 $min^{-1}$ and at most about 200 $min^{-1}$ is favorable.

If the brush is moved back and forth to remove the extraneous matter, a frequency of that round trip movement of at least about 30 $min^{-1}$ and at most about 120 $min^{-1}$ is favorable.

If a cloth is used as the extraneous material removal member, it may become possible to remove the burrs or extraneous material by fixing a plurality of rectangular or long, narrow cloths to an anchoring member at one end (one side) or attaching one surface of a thick, soft cloth to an anchoring member, for example, and bringing the other end or other surface into contact with the ceramic molded body while driving the anchoring member with at least one mode out of vibration, rotation, and translation.

If a sponge is used as the extraneous material removal member, it may become possible to remove the burrs or extraneous material by fixing one side of a soft, thick sponge, for example, to an anchoring member, and bringing the other side into contact with the ceramic molded body while driving the anchoring member with at least one mode out of vibration, rotation, and translation.

The buff types described above are not restricted, so a variety of buffs may be used; a disk-shaped buff, a flap-type buff, a spiral buff or other buff containing abrasive grains, a buff without abrasive grains such as a polypropylene non-woven cloth, and the like may be used, for example.

Aluminum silicate, aluminum oxide, silicon carbide, and the like may be used, for example, for the abrasive grains used in the buff containing abrasive grains described above.

If a buff is used as an extraneous matter removal member, it may become possible to remove the burrs or extraneous material by driving the buff with at least one mode out of vibration, rotation, and translation while bringing the buff into contact with the ceramic molded body, for example.

The type of grindstone described above is not restricted; a variety of grindstones may be used, examples of which include a resinoid grindstone (resin type), a magnesia grindstone (cement type), a diamond grindstone, a rubber control grindstone, and an epoxy control grindstone, and the like.

If a grindstone is used as the extraneous matter removal member, it may become possible to remove the burrs or extraneous material by driving the grindstone with at least one mode out of vibration, rotation, and translation while bringing the grindstone into contact with the ceramic molded body, for example.

If the sheet-shaped object is used as the extraneous matter removal member, it may become possible to remove the burrs or extraneous material by using an object containing sheet grinding material with a grain size between #A60 and A240, and driving the sheet-shaped object with at least one mode chosen between vibration, rotation, and translation while bringing the sheet-shaped object into contact with the ceramic molded body, for example.

For the sheet-shaped object, an object to which aluminum silicate, aluminum oxide, silicon carbide or other such abrasive grains are adhered to an urethane sponge, a nylon nonwoven cloth, an acryl (sponge), or the like may be used, for example.

It is desirable to provide the extraneous matter removal member with a dust collection device to move (suction) the removed burrs. The dust collection device is provided with a cover for covering the portions other than those that contact the ceramic molded body, a cylindrical object extending from the cover, a vacuum pump, a fan, a suction device, and other air suctioning means for suctioning the air through the cylindrical object.

The disposition method for the air blowing outlet and the extraneous material removal member is not particularly restricted; for example, the air blowing outlet may be disposed at one of the end sides of the ceramic molded body and the extraneous material removal member disposed at the other end, though it is desirable for the air blowing outlet and the extraneous material removal member to be disposed at the same cut face side of the ceramic molded body.

Desirably, the ceramic molded body is cut at two places so that both end faces of the ceramic molded body have cut faces, since this may make it easier to obtain a ceramic molded body with an accurate length and flat cut faces.

It is desirable to carry out the processing of the cut face on both end faces of the ceramic molded body at the same time for ceramic molded bodies having such cut faces, since this may make it easier to process the cut faces efficiently.

In accordance with the end face processing apparatus according to the embodiments of the present invention, the air blowing outlet and the extraneous matter removal member are used to remove burrs remaining on the cut face of honeycomb molded bodies during cutting and powder adhering to the honeycomb molded bodies, so the burrs and the powder may be more easily removed completely.

Next, the end face processing method for a honeycomb molded body according to the embodiments of the present invention is described.

The end face processing method for honeycomb molded bodies according to the embodiments of the present invention is an end face processing method for honeycomb molded bodies in which many cells are arranged along a long side divided by a cell wall and a cut face of a pillar-shaped honeycomb molded body whose end face has been cut is processed using an end face processing apparatus, wherein:

the end face processing apparatus is provided with an air blowing outlet and an extraneous matter removal member, and the extraneous matter removal member is driven with at least one mode out of vibration, rotation, and translation while brought into contact with the cut face, and air is blown out of the air blowing outlet to remove burrs remaining on the cut face and powder adhering to the cut face and the periphery thereof.

In the cut face processing method for honeycomb molded bodies according to the embodiments of the present invention, honeycomb molded bodies are the object of end face processing, and the honeycomb molded body is a type of ceramic molded body having many cells arranged along a long side divided by a cell wall.

Figure 3A:
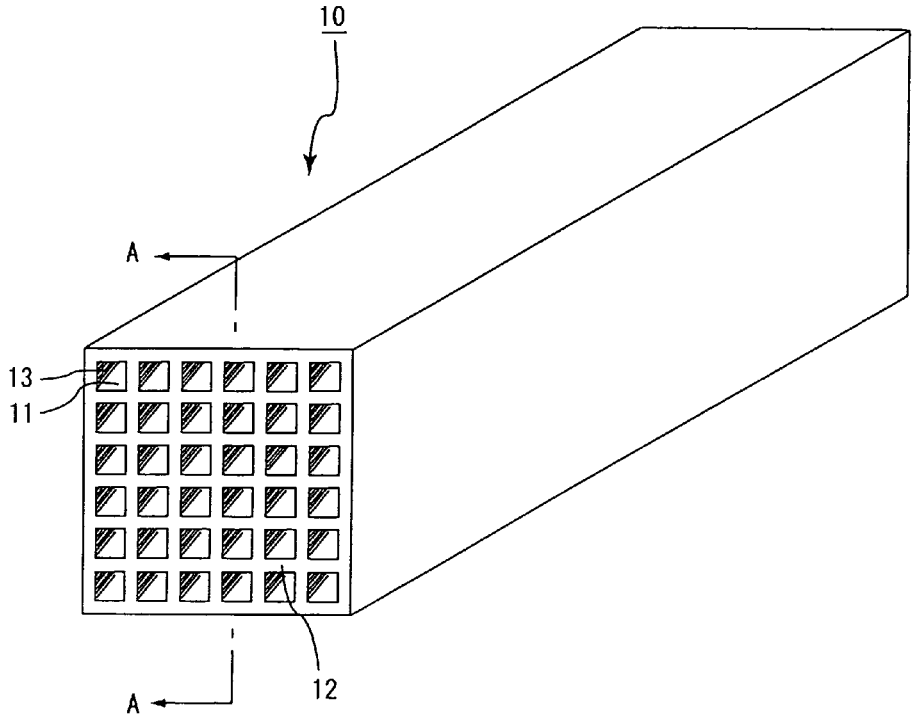
FIG. 3A is a perspective view schematically showing a honeycomb molded body 10 both sides of which have been cut.
Figure 3B:
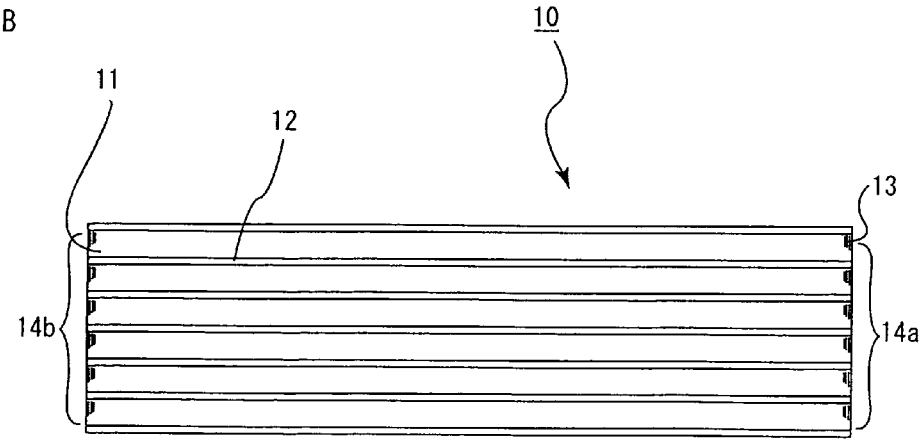
FIG. 3B is a cross-section view of the line A-A therein.

FIG. 3A is a perspective view schematically showing a honeycomb molded body 10, both end faces of which have been cut, and FIG. 3B is a cross-section view of the line A-A therein.

As shown in FIG. 3A, the honeycomb molded body 10 is a quadrilateral pillar-shaped honeycomb molded body having many cells 11 with a square cross-section arranged along a long side divided by a cell wall 12, both end faces having been cut, and both end faces 14*a* and 14*b* being the cut faces.

Both of the end faces 14*a* and 14*b* are thus cut, so burrs 13 remain on the cut faces, and powder, not illustrated in FIGS. 3A and 3B, that scattered during cutting, is adhered to the cut faces and the periphery thereof. In order to remove such burrs 13 and adhering powder, the end face processing is carried out using an end face processing apparatus according to one embodiment of the present invention.

If the honeycomb molded body that is the object of end face processing has many cells arranged along a long side divided by a cell wall and is a pillar-shaped honeycomb molded body with the end face cut, it is not particularly restricted, and the contour form of the cross-section may be square, rectangular, circular, elliptical, elongated circle or the like, for example. The cross-section shape of the cells is not particularly restricted, and may be square, rectangular, circular, elliptical, elongated circle or the like, for example.

The material comprising the honeycomb molded body is similar to the ceramic molded body described above, and has a ceramic powder and an organic binder as its main components. As with the ceramic molded body, the honeycomb molded body may contain a plasticizer or a lubricant, and a liquid dispersing medium may be left in the honeycomb molded body. Details were described in the section on the end face processing apparatus according to the embodiments of the present invention, so they are omitted here.

The end face processing apparatus used in the end face processing method for honeycomb molded bodies according to the embodiments of the present invention is similar to the end face processing apparatus according to the embodiments of the present invention described above, so a detailed description is omitted here.

Figure 4:
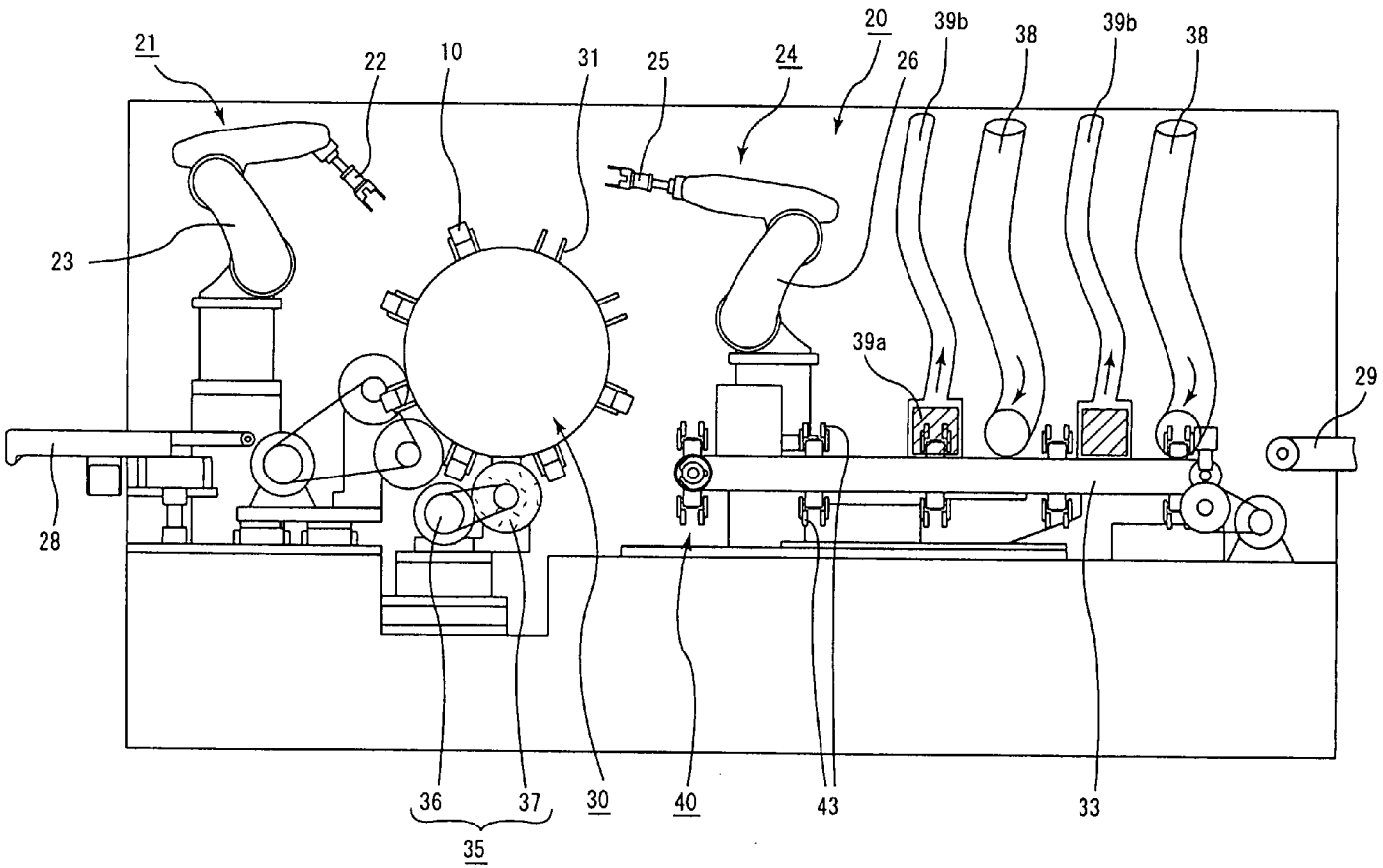
FIG. 4 is a vertical cross-section view schematically showing one embodiment of a molded body cutting processing device used in the end face processing method for honeycomb molded bodies.
Figure 5:
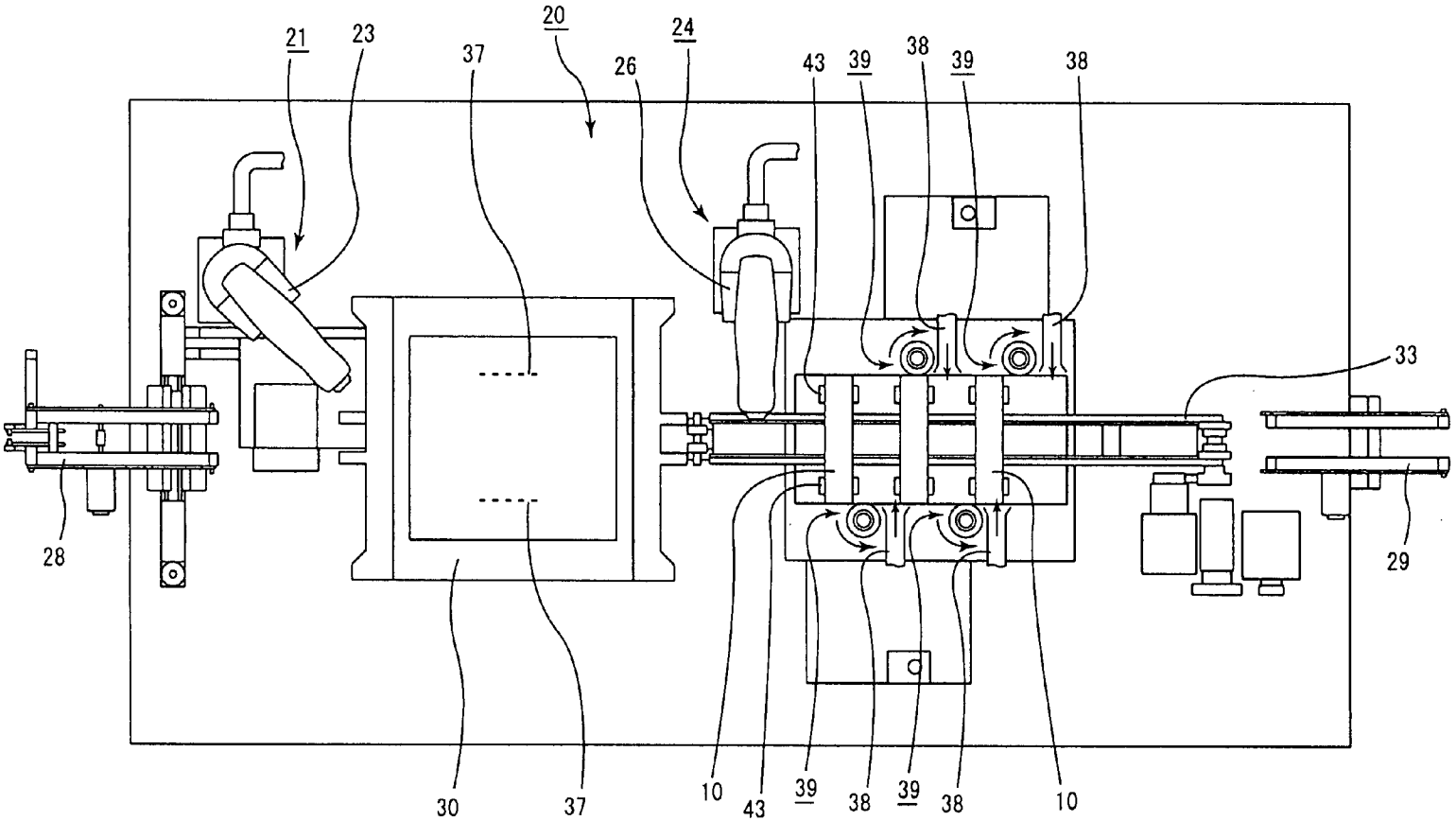
FIG. 5 is a horizontal cross-section view schematically showing one embodiment of the molded body cutting processing device used in the end face processing method for honeycomb molded bodies.

FIG. 4 is a vertical cross-section view schematically showing a molded body cutting processing device used in the end face processing method for honeycomb molded bodies according to one embodiment of the present invention, and FIG. 5 is a horizontal cross-section view schematically showing the molded body cutting processing device. The case where a roller with a brush is used as the extraneous material removal member is described below.

The molded body cutting device 20 is provided with two robot arms 21 and 24 provided with hands 22 and 25 having a grasping mechanism and bending portions 23 and 26 configured so as to be capable of bending freely to an angle; a rotating body 30 provided with many molded body loading portions 31, a cutting device 35 provided with a motor 36 and a cutting disk 37 disposed at either end of the rotating body 30; an air blowing device comprising an air hose 38 provided with an air blowing outlet and an air blowing means (not shown); and an extraneous material removal device 39 comprising an exhaust hose 39*b* and a roller with a brush 39*a* used as an extraneous material removal member. As shown in FIG. 5, two each of the air blowing device and the extraneous material removal device 39 are provided at either side of the region where the honeycomb molded bodies 10 pass through, for a total of four devices. The hands constituting the robot arms are not restricted to having a grasping mechanism, but may have a suction mechanism in lieu of the grasping mechanism, or may have both a grasping mechanism and a suction mechanism.

In the present specification, "robot arm" refers to an arm provided with an active joint with a motor or the like, and according to need, further provided with a non-active joint without a motor or the like.

With the molded body cutting device 20, the honeycomb molded body 10 conveyed by a belt conveyer 28 is lifted, moved, and loaded on a molded body loading portion 31 of a rotating body 30 by the hand 22 of the robot arm 21 having a grasping mechanism so as to be parallel with the rotational axis of the rotating body 30. The molded body loading portion 31 is provided with a movable anchoring member (not shown), thereby anchoring the honeycomb molded body 10, and releasing the anchoring. The robot arm 21 operates the anchoring member (not shown) and anchors the honeycomb molded body 10 on the molded body loading portion 31. During this interval, the rotating body 30 stops rotating.

Next, rotation of the rotating body 30 starts at a prescribed angle. The cutting disk 37 rotates constantly. When the honeycomb molded body 10 is carried to the position of the cutting disks 37 by the rotation of the rotating body 30, the interval between the two cutting disks 37 is set at a prescribed interval, so the honeycomb molded body 10 is cut near both of the end portions such that the long sides are cut to a prescribed length. At this time, powder generated through cutting adheres to the end portions and inside the cells of the honeycomb molded body 10, and burrs develop (see FIGS. 3A and 3B).

The cutting disks 37 do not necessarily need to rotate constantly; for example, they can be controlled to rotate when the molded body loading portion 31 is at the position closest to the two cutting devices 35.

After cutting, when the molded body loading portion 31 rotates until it reaches a prescribed position, the other robot arm 24 operates the anchoring member, and the anchoring of the honeycomb molded body 10 anchored to the molded body loading portion 31 is released. Then, the hand 25 of the robot arm 24 lifts the honeycomb molded body 10, the honeycomb molded body 10 is loaded onto loading portions 47*a* and 47*b* (see FIG. 6A) of a molded body anchoring device 40 installed at a belt conveyor 33 and is grasped by a hand 43.

The anchoring device is also referred to as a "chucking device".

Figure 6A:
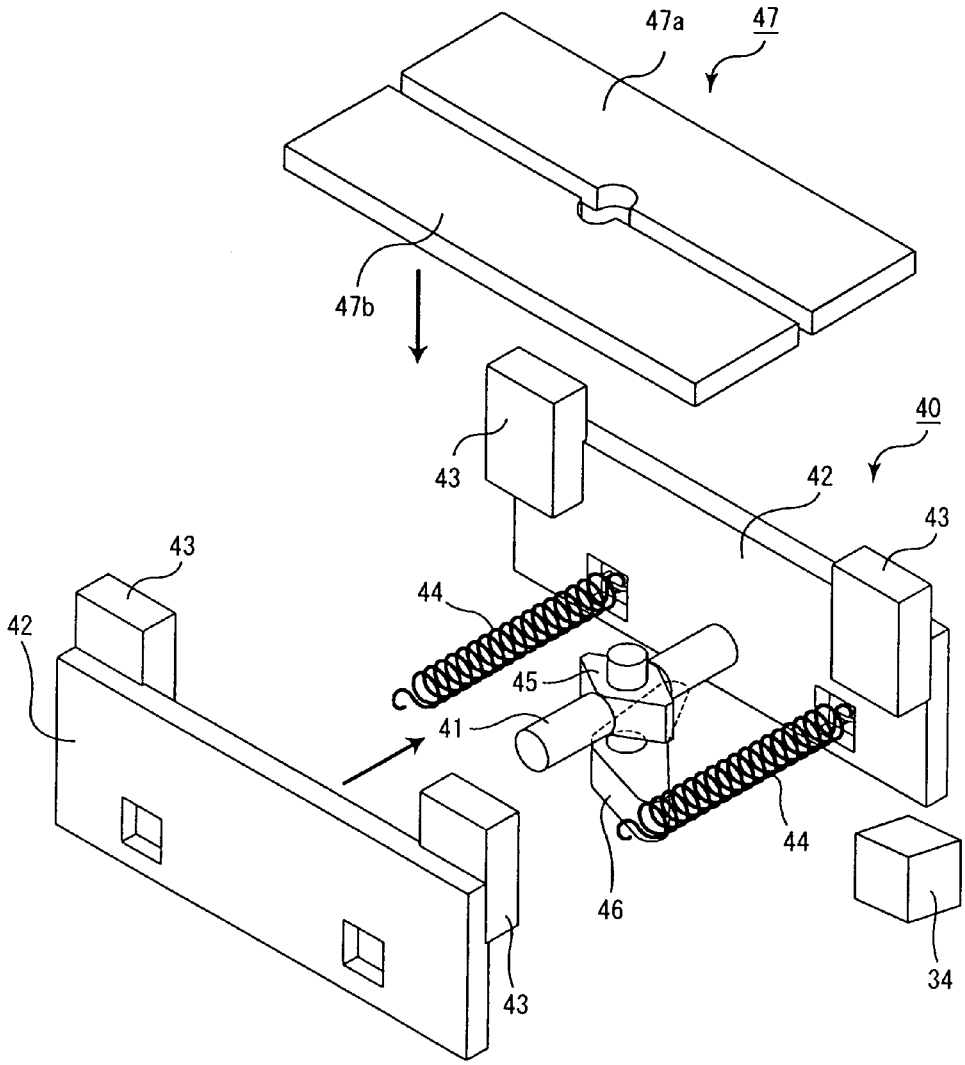
FIG. 6A is a partial disassembly perspective view showing a molded body anchoring device used in one embodiment of the molded body cutting processing device of the present invention.
Figure 6B:
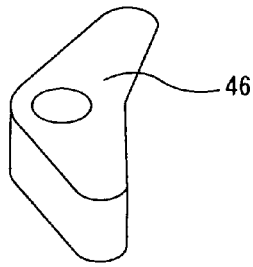
FIG. 6B is a perspective view showing a rotating member provided below an interval regulation member.

FIG. 6A is a partial disassembly perspective view showing the molded body anchoring device 40 which is used in one embodiment of the molded body cutting processing device of the present invention, and FIG. 6B is a perspective view showing the rotating member provided below an interval regulation member.

The molded body anchoring device 40 is provided at the belt conveyor 33 shown in FIGS. 4 and 5, and moves in accompaniment with the movement of the belt conveyor 33. The molded body anchoring device 40 comprises four (two sets of) hands 43 for grasping the honeycomb molded bodies 10, support plates 42 for supporting the hands 43, two spring members 44 provided between the support plates 42, a roughly rhombic interval regulation member 45 provided to regulate the interval between the hands 43, contact members 41 interposed between the support plates 42 and the interval regulation member 45 pushed apart or closer together by rotation of the interval regulation member 45, and a rotating member 46 provided below the interval regulation member 45 for causing the latter to rotate. The loading portions 47 (47*a* and 47*b*) made from flat panels are provided above the interval regulation member 45 for loading the honeycomb molded bodies thereon. The hands 43 and the support plate 42 on the left side are depicted to the left of the prescribed position, but in actuality, one end of the contact member 41 is joined with the support plate 42, and the loading portions 47 are provided slightly above the contact members 41.

The interval regulation member 45 is rhombic-shaped with chamfered corners, so the lengths of lines drawn to connect opposing corners are different. The difference in those lengths is used to regulate the interval between the two sets of hands 43. The two sets of hands 43 are supported by the two support plates 42, and these are joined by the two spring members 44 being provided such that the two support plates 42 are biased inwards. Further, the two contact members 41 and the interval regulation member 45 are provided between the two support plates 42.

As described above, the interval regulation member 45 has different lengths depending on the direction, so the interval between the two contact members 41 can be changed by altering the direction of the interval regulation member 45, thereby it may become possible to grasp the honeycomb molded body 10 loaded on the flat panel or release the grasp thereof.

As described above, the hand 25 of the robot arm 24 lifts the honeycomb molded body 10, which after being loaded on the loading portion 47 of the anchoring device 40 provided at the belt conveyor 33, the belt conveyor 33 moves forward, and the rotating member 46 comes into contact with a switching member 34 anchored to the bottom of the belt conveyor 33, and the rotating member 46 rotates to a prescribed angle, thereby causing the direction of the interval regulation member 45 to change, the interval between the two contact members 41 to decrease, and the honeycomb molded body 10 to be grasped by the hands 43.

The belt conveyor 33 then moves forward, and processing of the end face by the air blowing device and the extraneous material removal device 39 is carried out as described below. When the end portion of the belt conveyor 33 approaches, the rotating member 46 again comes into contact with the switching member 34 provided below the belt conveyor 33 and rotates to a prescribed angle, thereby changing the direction of the interval regulation member 45. The interval between the two contact members 41 thereby widens, and the honeycomb molded body 10 is simply loaded on the loading portion in a state not grasped by the hands 43, so a robot armor the like can be used to transfer it to the belt conveyor 29 in the next process. FIG. 6A shows the state where the interval between the two contact members 41 is narrow.

Next, the processing of end faces by the air blowing device and the extraneous material removal device 39 is described.

When the honeycomb molded body 10 grasped by the hand 43 proceeds along the belt conveyor 33, an end of the honeycomb molded body 10 comes into contact with the roller with a brush 39*a* provided at both sides of the belt conveyor 34. The roller with a brush 39*a* is rotating, so burrs formed by cutting are removed by the roller with a brush 39*a*, and the removed burrs and the like are discharged outside the system by the exhaust hose 39*b*.

Air is then blown from the air hose 38 constituting the air blowing device, completely removing powder adhering to the honeycomb molded body 10. In effect, in an advantageous embodiment according to the present invention, air is desirably blown inside the cells of the honeycomb molded body 10.

As shown in FIG. 5, the air hoses 38 provided with air blowing outlets at both sides are provided at a position different from the direction of the belt conveyor movement, and air is blown at the honeycomb molded body 10 such that the air direction of the respective air hoses 38 do not overlap with each other.

Accordingly, after both end faces of the honeycomb molded body 10 come into contact with the rotating roller with a brush 39*a* at different times, air from the air hose 38 comes into contact with the end faces and is blown inside the cells of the honeycomb molded body 10. Accordingly, powder adhering to the end faces, the side faces, and inside the cells of the honeycomb molded body 10 may be more easily to be blown away completely and removed. The air is suctioned by a separate suction device which is not shown and exhausted outside the system so as less likely to attach to the honeycomb molded body 10 or the like again.

In the molded body cutting device 20 described above, two sets of the air blowing device and the extraneous material removal device 39 are not necessarily required at both sides of the honeycomb molded body 10; after one end face is processed, the honeycomb molded body 10 may be rotated, etc., so that both end faces of the honeycomb molded body 10 processed, though from the perspective of efficient processing, it is desirable to provide two sets each of the air blowing device and the extraneous material removal device 39 on both sides of the honeycomb molded body 10.

In accordance with the end face processing method for honeycomb molded bodies according to the embodiments of the present invention, an extraneous matter removal member is driven with at least one mode chosen between vibration, rotation, and translation while brought into contact with the cut face, and air is blown out of the air blowing outlet, so burrs remaining on the cut face and powder adhering to the honeycomb molded bodies may be more easily to be removed completely.

Next, the manufacturing method of the honeycomb structure according to the embodiments of the present invention is described.

The manufacturing method for honeycomb structures of the present invention is a manufacturing method for honeycomb structures for manufacturing honeycomb structures made from honeycomb fired bodies by molding ceramic raw materials, to fabricate pillar-shaped honeycomb molded bodies in which many cells are arranged along a long side divided by a cell wall, cutting both sides of the honeycomb molded bodies, processing the cut face using an end face processing apparatus, and then firing the honeycomb molded bodies, wherein:

the end face processing apparatus is provided with an air blowing outlet and an extraneous matter removal member, and the extraneous matter removal member is driven with at least one mode out of vibration, rotation, and translation while brought into contact with the cut face, and air is blown out of the air blowing outlet to remove burrs remaining on the cut face and powder adhering to the cut face and the periphery thereof.

As described above, in the manufacturing method for honeycomb structures of the present invention, a mixture including a ceramic raw material is formed, a pillar-shaped honeycomb molded body in which many cells are arranged along a long side divided by a cell wall is produced, both ends of the honeycomb molded body are cut, and an end face processing is carried out thereafter to process the cut face using an end face processing apparatus; then, the honeycomb molded body is fired to manufacture a honeycomb fired body, a plurality of honeycomb fired bodies are attached through an adhesive layer, the result is processed to a prescribed form, and a sealing material layer is provided at the outer periphery to manufacture a honeycomb structure.

In the manufacturing method for honeycomb structures of the present invention, both ends of a honeycomb molded body are cut, after which an end face processing apparatus is used to cut the cut faces. The end face processing apparatus is not particularly restricted; the end face processing apparatus according to the embodiments of the present invention described above may be used. Also, the end face processing method is not particularly restricted; the end face processing method according to the embodiments of the present invention described above may be used.

Accordingly, the end face processing is described extremely briefly, and processes other than the end face processing are described.

Also, the example of manufacturing a honeycomb structure made from silicon carbide using silicon carbide powder as an inorganic powder is used for describing the manufacturing method for honeycomb structures.

The material for the honeycomb structures to be manufactured with the manufacturing method of the present invention is not restricted to silicon carbide; the ceramic types described in the section for the end face processing apparatus may be used.

The material for the honeycomb structure is favorably a non-oxide ceramic, and silicon carbide and a composite body of silicon carbide and silicon metal is particularly favorable. The material of the honeycomb structure described above is particularly favorably silicon-silicon carbide (Si—SiC). These are favorable because of their superior thermal resistance, mechanical strength, thermal conductivity, and other characteristics.

(1) In the manufacturing method for honeycomb structures of the present invention, silicon carbide powders with different average grain sizes and an organic binder (organic powder) are dry mixed to prepare a powder mixture.

The grain diameter of the silicon carbide powder described above is not particularly restricted; a powder with little constriction in the subsequent firing is favorable, and a combination of a 100 parts by weight of a powder having an average grain diameter of at least about 0.3 μm and at most about 50 μm and at least about 5 parts by weight and at most about 65 parts by weight of a powder having an average grain size of at least about 0.1 μm and at most about 1.0 μm, for example, is favorable. To control aeration hole diameter and the like for the honeycomb fired body, a method for controlling the firing temperature is effective, though the aeration hole diameter can be controlled to a fixed range depending on control of the grain diameter of the inorganic powder.

The organic binder described above is not particularly restricted; methyl cellulose, carboxymethylcellulose, hydroxyethylcellulose, polyethylene glycol, and the like may be used, for example. Among these, methyl cellulose is the most desirable.

A desirable blending amount of the binder described above is ordinarily at least about 1 part by weight and at most about 10 parts by weight to 100 parts by weight of inorganic powder.

(2) Next, a liquid mixture is prepared by mixing a liquid plasticizer, a lubricant, and water; the powder mixture prepared in process (1) described above and the liquid mixture described above are mixed using a wet mixer to prepare a wetting mixture for molded body manufacture.

The plasticizer described above is not particularly restricted; glycerol and the like may be used, for example.

The lubricant described above is not particularly restricted; polyoxyethylene alkyl ether, polyoxypropylene alkyl ether and other polyoxyalkylene compounds and the like may be used, for example.

Concrete examples for lubricants include polyoxyethylene monobutyl ether, polyoxypropylene monobutyl ether and the like, for example.

In some cases, the plasticizer and lubricant may not need to be contained in a wetting mixture.

When preparing the wetting mixture described above, a liquid dispersing medium may be used; for the dispersing medium mentioned above, water, an organic solvent such as benzene, an alcohol such as methanol, for example, may be used. A molding auxiliary agent may also be added to the wetting mixture described above.

Also, a balloon, which is a minute hollow sphere with an oxide ceramic as an ingredient, spherical acryl grains, and a porogen such as graphite may be added to the wetting mixture described above according to need.

(3) After preparation, the wetting compound described above is transported to an extrusion molder by a conveyor and, through extrusion molding, made into a pillar-shaped honeycomb molded body with many cells arranged along a long side divided by a cell wall.

Next, the honeycomb molded body described above is dried using a microwave dryer, a hot air dryer, a dielectric dryer, a reduced-pressure dryer, a vacuum dryer, a freeze dryer, or the like, the areas near both end portions of the honeycomb molded body are cut after drying as described above, and processing of both cut faces of the honeycomb molded body with an end face processing apparatus is carried out as described above.

Next, a prescribed quantity of a plug paste which forms plugs is filled into the end portion of the end of the outlet of the inlet cell group and the end of the inlet of the outlet cell group to seal off the cells according to need.

The plug paste mentioned above is not particularly restricted; one with the plugs having an aeration hole ratio of at least about 30% and at most about 75% manufactured in a later process is desirable; one similar to the wetting mixture described above, for example, may be used.

Filling of the plug paste described above may be carried out according to need, and if the plug paste described above is used for filling, a honeycomb structure obtained in a later process, for example, may be favorably used as a ceramic filter, but if the plug paste described above is not used for filling, a honeycomb structure obtained in a later process, for example, may be favorably used as a catalyst supporter.

(4) Next, the honeycomb molded body 10 filled with the plug paste described above is degreased (at a temperature of at least about 200° C. and at most about 600° C., for example) and fired (at a temperature of at least about 1400° C. and at most about 2300° C., for example) under prescribed conditions, thereby manufacturing a honeycomb fired body (see FIGS. 2A and 2B) whose entirety is constructed from one fired body, having a plurality of cells arranged along a long side divided by a cell wall, and with either end of the above-mentioned cells sealed.

Conditions conventionally used when manufacturing a filter from porous ceramic may be used for the conditions for degreasing and firing the honeycomb molded body mentioned above.

(5) Next, a gap retention material which serves as a spacer is applied to the side of the honeycomb fired body according to need, a sealing material paste made from a sealing material layer (adhesive layer) is applied with a uniform thickness to form a sealing material paste layer, and layering of other honeycomb fired bodies onto the sealing material paste layer is successively repeated to fabricate an aggregate of honeycomb fired bodies of a prescribed size.

In the manufacturing method for honeycomb structures of the present invention, the sealing material paste may be collectively filled into the gaps between the honeycomb fired bodies after a necessary number of honeycomb fired bodies are put together through the gap retention material described above.

For the sealing material paste described above, one made from an inorganic binder, an organic binder, an inorganic fiber, and/or inorganic grains may be used, for example.

Silica sol, aluminum oxide sol or the like may be used for the inorganic binder mentioned above. These may be used individually or in a combination of two or more. Between the above-mentioned inorganic binders, silica sol is the most desirable.

For the organic binder mentioned above, polyvinyl alcohol, methyl cellulose, ethylcellulose, carboxymethylcellulose, and the like may be used, for example. These may be used individually or in a combination of two or more. Among the organic binders mentioned above, carboxymethylcellulose is the most desirable.

As the inorganic fiber mentioned above, silica aluminum oxide, mullite, aluminum oxide, silica or other ceramic fiber, or the like may be used, for example. These may be used individually or in a combination of two or more. Among the inorganic fibers mentioned above, aluminum oxide fiber is the most desirable.

For the inorganic grains mentioned above, a carbide, nitride, or the like may be used for example, and an inorganic powder made from silicon carbine, silicon nitride, and boron nitride may be provided as a concrete example. These may be used individually or in a combination of two or more. For the inorganic grain mentioned above, a silicon carbide with superior thermal conductivity is the most desirable.

A balloon, which is a minute hollow sphere with an oxide ceramic as an ingredient, spherical acryl grains, and a porogen such as graphite may be added to the sealing material paste mentioned above, according to need.

The balloon mentioned above is not particularly restricted; an aluminum oxide balloon, a glass micro-balloon, a shirasu (a gray volcanic ash) balloon, a fly ash (FA) balloon, a mullite balloon, or the like may be used, for example. Among these, an aluminum oxide balloon is the most desirable.

(6) Next, the aggregate of the honeycomb fired bodies is heated to dry and harden the sealing material paste layer, forming a sealing material layer (adhesive layer).

Next, a diamond cutter or the like is used to cut the aggregate of the honeycomb fired bodies, wherein a plurality of honeycomb fired bodies are attached together through the sealing material layer, to produce a cylindrical ceramic block.

The form of the ceramic block mentioned above manufactured with this manufacturing method is not restricted to a cylindrical shape, but may be an elliptical or other such pillar shape.

Then, the sealing material paste is used on the outer periphery of the honeycomb block to form a sealing material layer (coat layer). By carrying out such processes, a honeycomb structure (see FIG. 1) provided with a sealing material layer (coat layer) at the outer periphery of a cylindrical ceramic block on which a plurality of honeycomb fired bodies are attached through a sealing material layer (adhesive layer) can be manufactured.

In the manufacturing method for honeycomb structures of the present invention, the honeycomb structures may then be made to support catalysts according to need.

The above-mentioned catalyst support may also be carried out on the honeycomb fired bodies before producing the aggregates.

If the catalyst support is used, it is desirable to form an aluminum oxide film with a high specific surface area on the surface of the honeycomb structure, and provide an auxiliary catalyst and a catalyst such as platinum on the surface of the aluminum oxide film.

For the formation of the aluminum oxide film on the surface of the honeycomb structures mentioned above, a method for impregnating the honeycomb structures with a metal compound solution containing aluminum such as $Al(NO_3)_3$ and heating, or a method for impregnating the honeycomb structures with a solution containing aluminum oxide powder and heating, for example, may be used.

For providing the aluminum oxide film with an auxiliary catalyst, a method for impregnating the honeycomb structures with a metal compound solution containing a rare earth element such as $Ce(NO_3)_3$ or the like and heating, for example, may be used.

For providing the aluminum oxide film with a catalyst as described above, a method for impregnating the honeycomb structures with a diammine dinitro platinum nitric acid solution ($[Pt(NH_3)_2(NO_2)_2]HNO_3$ with a platinum concentration of about 4.53 weight-percent) and heating, for example, may be used.

Also, a catalyst may be provided using a method where aluminum oxide grains are provided with a catalyst beforehand, the honeycomb structures are impregnated with a solution containing the aluminum oxide powder having the catalyst, and heating.

The manufacturing method for honeycomb structures according to the embodiments of the present invention described thus far is for honeycomb structures having a plurality of honeycomb fired bodies bound together through a sealing material layer (adhesive layer) (hereinafter, also referred to as an aggregate honeycomb structure), but the honeycomb structures manufactured through the manufacturing method for honeycomb structures according to the embodiments of the present invention may also be honeycomb structures in which a cylindrical ceramic block is constructed from one honeycomb fired body (hereinafter, also referred to as a single type honeycomb structure).

For manufacturing such a single type honeycomb structure, the honeycomb molded body is produced using a method similar to the manufacturing of aggregate honeycomb structures except the size of the honeycomb molded body formed with extrusion molding is larger than that of the former.

The method and the like for mixing a raw material powder is similar to that for manufacturing the aggregate honeycomb structures described above, so the description is omitted here.

Next, the above-mentioned honeycomb molded body is dried using a microwave dryer, a hot air dryer, a dielectric dryer, a reduced-pressure dryer, a vacuum dryer, a freeze dryer, or the like, as with manufacturing aggregate honeycomb structures. Next, a prescribed quantity of a plug paste which forms a plug is filled into the end portion of the outlet of the inlet cell group and the end portion of the inlet of the outlet cell group to seal off the cells.

Then, a ceramic block is manufactured by degreasing, firing, and extraneous material removal as in the manufacturing of the aggregate honeycomb structures, and a sealing material layer (coat layer) is formed, according to need, to manufacture a single type honeycomb structure. By carrying out the extraneous material removal mentioned above, the sealing material layer can be favorably formed.

The above-mentioned method for supporting the catalysts may be used for the single type honeycomb structures as well.

When manufacturing honeycomb structures using a manufacturing method such as that described above, in a case where the aggregate honeycomb structures are manufactured, it is desirable for the main constituent of the material to be silicon carbide, or metal silicon and silicon carbide, and when manufacturing a single type honeycomb structure, it is desirable to use cordierite or aluminum titanate.

In accordance with the manufacturing method for honeycomb structures according to the embodiments of the present invention, an extraneous matter removal member is driven with at least one mode chosen between vibration, rotation, and translation while brought into contact with the cut face, and air is blown out of the air blowing outlet, so burrs remaining on the cut face and powder adhering to the honeycomb molded bodies may be more easily removed completely.

EXAMPLES

Examples of embodiment are provided below to further describe the present invention in detail, though the present invention is not restricted thereto.

Example 1

(1) 250 kg of α-type silicon carbide powder having an average grain diameter of 10 m, 100 kg of α-type silicon carbide powder having an average grain diameter of 0.5 μm, and 20 kg of an organic binder (methyl cellulose) were mixed to prepare a powder mixture.

Next, 12 kg of a lubricant (Unilube, manufactured by NOF Corp.), 5.6 kg of a plasticizer (glycerol), and 64 kg of water were mixed to separately prepare a liquid mixture, and the liquid mixture and the powder mixture were mixed together using a wet mixer to prepare a wetting mixture.

Extrusion molding using the wetting mixture followed by cutting was then carried out to produce honeycomb molded bodies.

(2) Next, the honeycomb molded bodies described above were dried with a microwave dryer, a paste with a composition similar to that of the honeycomb molded bodies described above was used to fill in prescribed cells, and the result was dried again with a dryer.

(3) The molded body cutting device 20 shown in FIGS. 4 and 5 was used to cut the honeycomb molded bodies 10, producing the honeycomb molded bodies 10 whose long side was 301 mm in length.

(4) Burrs were generated and powder adhered to the honeycomb molded body as a result of the cutting described above, so the air hose 38 and the extraneous material removal device 39 including the roller with a brush 39*a* shown in FIGS. 4 and 5 were used to remove the burrs formed on the honeycomb molded body 10 and the powder adhering to the honeycomb molded body 10.

Figure 2A:
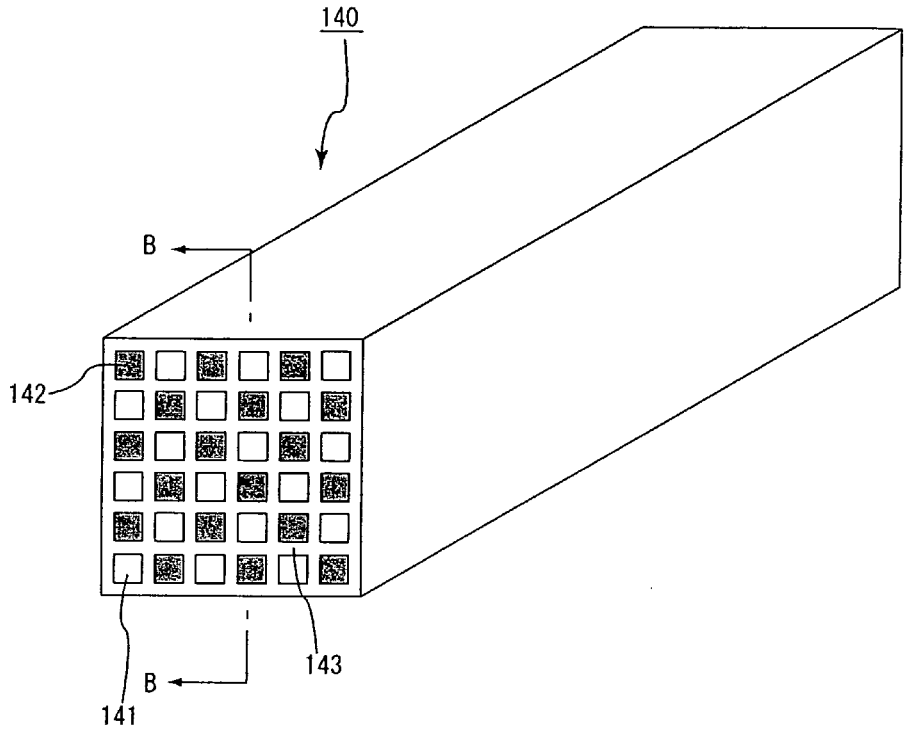
FIG. 2A is a perspective view schematically showing a honeycomb fired body constituting the honeycomb structures.
Figure 2B:
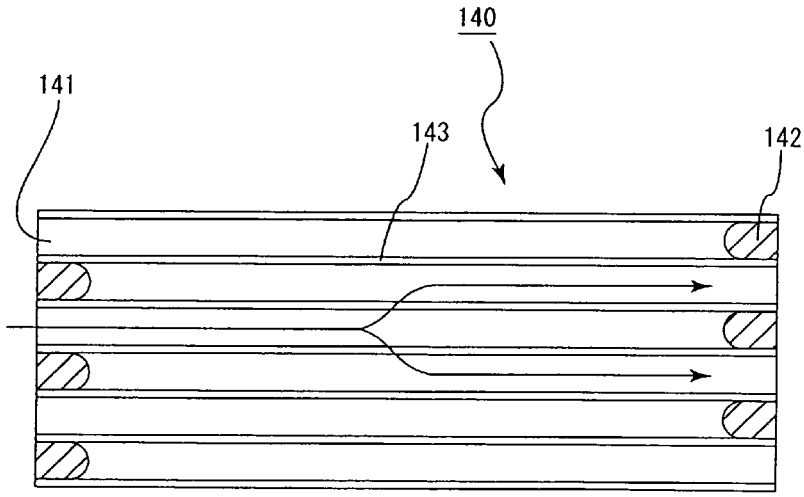
FIG. 2B is a cross-section view of the B-B line therein.

(5) Next, sealing of the honeycomb molded body 10 was carried out by filling with a plug paste in a checkered pattern as shown in FIGS. 2A and 2B, to produce honeycomb molded bodies where one end portion of the cell was sealed by the plug layer.

(6) Degreasing of the honeycomb molded bodies 10 was then carried out in a $N_2$ atmosphere at 300° C., followed by firing in an argon atmosphere at steady pressure, 2200° C. for 3 hours, to produce honeycomb fired bodies 140 (see FIGS. 2A and 2B) made from silicon carbide fired bodies 34 mm×34 mm×300 mm in size with the number of cells 45 pcs/$cm^2$ and a cell wall thickness of 0.25 mm.

(7) Next, a thermally resistant sealing material paste containing 30 weight-percent of aluminum oxide fiber whose average fiber length was 20 μm, 21 weight-percent of silicon carbide grains whose average grain diameter was 0.6 μm, 15 weight-percent of silica sol, 5.6 weight-percent of carboxymethylcellulose, and 28.4 weight-percent of water was prepared. The viscosity of this sealing material paste at room temperature was 30 Pa·s.

(8) Next, the sealing material paste was applied to the side of the honeycomb fired bodies 140, a plurality of which were bound together through the sealing material paste, and the result was dried to produce an aggregate of honeycomb fired bodies in which many honeycomb fired bodies 140 were aggregated.

(9) The aggregate of the honeycomb fired bodies mentioned above was cut into a cylindrical shape with a diameter of 142 mm using a diamond cutter to produce a cylindrical ceramic block 133.

(10) Next, 23.3 weight-percent of ceramic fiber (shot content: 3%, average fiber length: 100 μm) made from aluminum oxide silicate as an inorganic fiber, 30.2 weight-percent of silicon carbide powder with an average grain diameter of 0.3 μm as inorganic grains, 7 weight-percent of silica sol (content of $SiO_2$ in the sol: 30 weight-percent) as an inorganic binder, 0.5 weight-percent of carboxymethylcellulose as an organic binder, and 39 weight-percent of water were mixed and kneaded to prepare a sealing material paste.

(11) The sealing material paste described above was then used to form a sealing material paste layer at the outer periphery of the ceramic block 133. The sealing material paste layer was then dried at 120° C. to produce the cylindrical honeycomb structure 130 with a diameter of 143.8 mm and length of 300 mm on whose outer periphery a sealing material layer (coat layer) was formed.

Example 2

Other than using a member having one end (one side) of a long, narrow cloth anchored to an anchoring member as the extraneous matter removal member instead of a roller with a brush, and rotating this member to remove burrs and the like in process (4) of Example 1, a honeycomb structure was produced in the same manner as in Example 1.

Example 3

Other than using a member having a urethane sponge anchored to an anchoring member as the extraneous matter removal member instead of a roller with a brush, and using the member to remove burrs and the like in process (4) of Example 1, a honeycomb structure was produced in the same manner as in Example 1.

Example 4

(1) 80 kg of α-type silicon carbide powder having an average grain diameter of 50 μm, 20 kg of silicon powder having an average grain diameter of 4.0 μm, and 11 kg of an organic binder (methyl cellulose) were mixed to prepare a powder mixture.

Next, 3.3 kg of a lubricant (Unilube, manufactured by NOF Corp.), 1.5 kg of a plasticizer (glycerol), and a suitable quantity of water were mixed to separately prepare a liquid mixture, and the liquid mixture and the powder mixture were mixed together using a wet mixer to prepare a wetting mixture.

The α-type silicon carbide powder here underwent an oxidation treatment for 3 hours at 800° C.

Extrusion molding using the wetting mixture followed by cutting was then carried out to produce honeycomb molded bodies.

(2) Next, the honeycomb molded bodies described above were dried with a microwave dryer, a paste with a composition similar to that of the honeycomb molded bodies described above was used to fill in prescribed cells, and the result was dried again with a dryer.

(3) The molded body cutting device 20 shown in FIGS. 4 and 5 was used to cut the honeycomb molded bodies 10, producing the honeycomb molded bodies 10 whose long side was 301 mm in length.

(4) Burrs were generated and powder adhered to the honeycomb molded body as a result of the cutting described above, so the air hose 38 and the extraneous material removal device 39 including the roller with a brush 39*a* shown in FIGS. 4 and 5 were used to remove the burrs formed on the honeycomb molded body 10 and the powder adhering to the honeycomb molded body 10.

(5) Next, sealing of the honeycomb molded body 10 was carried out by filling with a plug paste in a checkered pattern as shown in FIGS. 2A and 2B, producing honeycomb molded bodies where one end portion was sealed by the plug layer.

(6) Degreasing of the honeycomb molded bodies 10 was then carried out in a $N_2$ atmosphere at 300° C., followed by firing in an argon atmosphere at steady pressure, 2200° C. for 3 hours, to produce honeycomb fired bodies 140 made from silicon-silicon carbide (Si—SiC), 34 mm×34 mm×300 mm in size with the number of cells 45 pcs/$cm^2$ and a cell wall thickness of 0.25 mm in the form shown in FIGS. 2A and 2B.

(7) Next, a thermally resistant sealing material paste containing 30 weight-percent of aluminum oxide fiber whose average fiber length was 20 μm, 21 weight-percent of silicon carbide grains whose average grain diameter was 0.6 μm, 15 weight-percent of silica sol, 5.6 weight-percent of carboxymethylcellulose, and 28.4 weight-percent of water was prepared. The viscosity of the sealing material paste at room temperature was 30 Pa·s.

(8) Next, the sealing material paste was applied to the side of the honeycomb fired bodies 140, a plurality of which were bound together through the sealing material paste, and the result was dried to produce an aggregate of honeycomb fired bodies in which many honeycomb fired bodies 140 were aggregated.

(9) The aggregate of the honeycomb fired bodies mentioned above was cut into a cylindrical shape with a diameter of 142 mm using a diamond cutter to produce a cylindrical ceramic block 133.

(10) Next, 23.3 weight-percent of ceramic fiber (shot content: 3%, average fiber length: 100 μm) made from aluminum oxide silicate as an inorganic fiber, 30.2 weight-percent of silicon carbide powder with an average grain diameter of 0.3

μm as inorganic grains, 7 weight-percent of silica sol (content of $SiO_2$ in the sol: 30 weight-percent) as an inorganic binder, 0.5 weight-percent of carboxymethylcellulose as an organic binder, and 39 weight-percent of water were mixed and kneaded to prepare a sealing material paste.

(11) The sealing material paste described above was then used to form a sealing material paste layer at the outer periphery of the ceramic block 133. The sealing material paste layer was then dried at 120° C. to produce the cylindrical honeycomb structure 130 with a diameter of 143.8 mm and length of 300 mm on whose outer periphery a sealing material layer (coat layer) was formed.

Example 5

Other than using a member having one end (one side) of a long, narrow cloth anchored to an anchoring member as the extraneous matter removal member instead of a roller with a brush, and rotating this member to remove burrs and the like in process (4) of Example 4, a honeycomb structure was produced in the same manner as in Example 4.

Example 6

Other than using a member having an urethane sponge anchored to an anchoring member as the extraneous matter removal member instead of a roller with a brush, and rotating this member to remove burrs and the like in process (4) of Example 4, a honeycomb structure was produced in the same manner as in Example 4.

Comparative Example 1

An attempt was made to manufacture the honeycomb structures the same as in Example 1 omitting process (4) of Example 1, that is, without removing the burrs or extraneous material, but the burrs interfered in the sealing of the honeycomb molded bodies, so the end portion of the cells of the honeycomb molded bodies 10 could not be filled with the plug paste.

Comparative Example 2

Other than not blowing air from the air hose 38 and carrying out the removal of burrs using only the extraneous material removal device 39 including the roller with a brush 39*a* in process (4) of Example 1, the honeycomb structures were manufactured in the same manner as in Example 1.

Reference Example 1

With the exception of providing a roller with a brush on one of the cut face sides of the honeycomb molded body 10, bringing it into contact with that cut face, providing the air hose 38 on the remaining cut face side, and bringing that cut face into contact with the air, honeycomb structures were manufactured in the same manner as in Example 1.

In order to determine whether the filling material layer at the end portion of the cells constituting the honeycomb fired bodies manufactured in Examples 1 to 6, Comparative Example 2, and Reference Example 1, light was externally irradiated from the end face of the honeycomb structure, and a light sensor was used to observe whether light leaked inside the cells.

It was found that with the honeycomb structures manufactured in Examples 1 to 6, there was no light leakage whatsoever, and the honeycomb structures were completely filled with a filling material, but in contrast to these cases, light leaked inside a number of cells in the honeycomb structures for Comparative Example 2 and Reference Example 1, so there were portions where the filling of the cell end portion with the filling material was incomplete.

It is concluded that this is because the removal of burrs and powder adhering inside the cells was not completely carried out in process (4), so burrs and powder adhered inside the cells, irregular surfaces formed inside the cells, and filling with the filling material was inadequate.

What is claimed as new and desired to be secured by Letters Patent of the United States is:

1. An end face processing method for a honeycomb molded body comprising:

providing a pillar shaped honeycomb molded body having a plurality of cells arranged in a longitudinal direction of the honeycomb molded body, said honeycomb molded body having a cut end face including burrs and powders made of the same material as the honeycomb molded body, wherein said burrs and powders are formed by cutting an end portion of the honeycomb molded body to obtain the cut end face;

providing a cut end face processing apparatus comprising a plurality of air blowing outlets and an extraneous matter removal member;

driving the extraneous matter removal member with at least one mode chosen from vibration, rotation, and translation;

contacting the cut end face directly with the extraneous matter removal member so that burrs on the cut end face are removed;

positioning the plurality of air blowing outlets so that at a given time only one air blowing outlet is aligned with the honeycomb molded body in its longitudinal direction;

blowing air from a first of the plurality of air blowing outlets to remove powders adhering to the cut end face, wherein the air flow passes through the plurality of cells of the honeycomb molded body; and blowing air from a second of the plurality of air blowing outlets to remove powders adhering to the cut end face, wherein the air flow passes through the plurality of cells of the honeycomb molded body;

wherein the first air blowing outlet and the second air blowing outlet are on opposite sides of the honeycomb molded body.

2. The end face processing method for a honeycomb molded body according to claim 1, wherein said extraneous matter removal member comprises one member chosen from a brush, a cloth, a sponge, a buff, a grindstone, and a sheet-shaped object.

3. The end face processing method for a honeycomb molded body according to claim 1, further comprising using a roller with a brush as said extraneous material removal member and bringing said roller with a brush into contact with said cut end face during rotation of the roller with a brush.

4. The end face processing method for a honeycomb molded body according to claim 1, wherein said plurality of air blowing outlets and said extraneous matter removal member are provided at the same side of the cut end face of said honeycomb molded body.

5. The end face processing method for a honeycomb molded body according to claim 1, wherein the honeycomb molded body has two cut end faces that have said burrs and powders, and both cut end faces are subject to the contacting and the blowing steps.

6. The end face processing method for a honeycomb molded body according to claim 1, wherein each of said plurality of air blowing outlets is provided with a cylindrical object connected with an air blowing means so that air is blown out from said cylindrical object.

7. The end face processing method for a honeycomb molded body according to claim 1, wherein a rate of air blowing out from one of said plurality of air blowing outlets is at least about 1 m/sec and at most about 10 m/sec.

8. The end face processing method for a honeycomb molded body according to claim 1, wherein said extraneous matter removal member is provided with a dust collection device.

9. A method for manufacturing a honeycomb structure, comprising:

obtaining a pillar-shaped honeycomb molded body that comprises a plurality of cells arranged in a longitudinal direction of the honeycomb molded body;

cutting two end portions of the honeycomb molded body to obtain two cut end faces, wherein each of the two cut end faces includes burrs and powders made of the same material as the honeycomb molded body, wherein said burrs and powders are formed by cutting two end portions of the honeycomb molded body;

providing a cut end face processing apparatus comprising a plurality of air blowing outlets and an extraneous matter removal member;

driving the extraneous matter removal member with at least one mode chosen from vibration, rotation, and translation;

contacting at least one of the two cut end faces directly with the extraneous matter removal member so that burrs on the cut end face are removed;

positioning the plurality of air blowing outlets so that at a given time only one air blowing outlet is aligned with the honeycomb molded body in its longitudinal direction;

blowing air from a first of the plurality of air blowing outlets to remove powders adhering to the cut end face, wherein the air flow passes through the plurality of cells of the honeycomb molded body;

blowing air from a second of the plurality of air blowing outlets to remove powders adhering to the cut end face, wherein the air flow passes through the plurality of cells of the honeycomb molded body, wherein the first air blowing outlet and the second air blowing outlet are on opposite sides of the honeycomb molded body; and firing the honeycomb molded body.

10. The method for manufacturing a honeycomb structure according to claim 9, wherein said extraneous matter removal member comprises one member chosen from a brush, a cloth, a sponge, a buff, a grindstone, and a sheet-shaped object.

11. The method for manufacturing a honeycomb structure according to claim 9, further comprising using a roller with a brush as said extraneous material removal member and bringing said roller with a brush into contact with said cut end face during rotation of the roller with a brush.

12. The method for manufacturing a honeycomb structure according to claim 9, wherein said plurality of air blowing outlets and said extraneous matter removal member are provided at the same side of one of the two cut end faces of said honeycomb molded body.

13. The method for manufacturing a honeycomb structure according to claim 9, wherein both cut end faces are subject to the contacting and the blowing steps.

14. The method for manufacturing a honeycomb structure according to claim 9, wherein each of said plurality of air blowing outlets is provided with a cylindrical object connected with an air blowing means so that air is blown out from said cylindrical object.

15. The method for manufacturing a honeycomb structure according to claim 9, wherein a rate of air blowing out from one of said plurality of air blowing outlets is at least about 1 m/sec and at most about 10 m/sec.

16. The method for manufacturing a honeycomb structure according to claim 9, wherein said extraneous matter removal member is provided with a dust collection device.

* * * * *